US010940602B2

(12) United States Patent
Van Happen et al.

(10) Patent No.: US 10,940,602 B2
(45) Date of Patent: Mar. 9, 2021

(54) FOOD SINGULATOR APPARATUS

(71) Applicants: MAREL A/S, Aarhus N (DK); MAREL MEAT B.V., Boxmeer (NL)

(72) Inventors: Frank-Willem Johan Martin Van Happen, Niew-Bergen (NL); Niels Hundtofte, Ega (DK); Lars Riis Jensen, Horning (DK)

(73) Assignees: MAREL MEAT B.V., Boxmeer (NL); MAREL A/S, Aarhusn (DK)

( * ) Notice: Subject to any disclaimer, the term of this patent is extended or adjusted under 35 U.S.C. 154(b) by 0 days.

(21) Appl. No.: 16/768,265

(22) PCT Filed: Dec. 5, 2018

(86) PCT No.: PCT/EP2018/083659
§ 371 (c)(1),
(2) Date: May 29, 2020

(87) PCT Pub. No.: WO2019/110666
PCT Pub. Date: Jun. 13, 2019

(65) Prior Publication Data

US 2020/0368933 A1 Nov. 26, 2020

(30) Foreign Application Priority Data

Dec. 5, 2017 (EP) ..... 17205355

(51) Int. Cl.
*B26D 7/32* (2006.01)

(52) U.S. Cl.
CPC ..... *B26D 7/32* (2013.01); *B26D 2210/02* (2013.01)

(58) Field of Classification Search
CPC ..... B26D 7/32; B26D 2210/02
See application file for complete search history.

(56) References Cited

U.S. PATENT DOCUMENTS 1,079,778 A * 11/1913 Linkiewicz ..... B26D 7/32 83/94
1,192,014 A * 7/1916 Stiles ..... B26D 7/32 83/96

(Continued)

FOREIGN PATENT DOCUMENTS

| | | | |
|---|---|---|---|
| DE | 102011011654 | A1 | 12/2011 |
| EP | 3009242 | A2 | 4/2016 |
| WO | 2005/087456 | A1 | 9/2005 |

OTHER PUBLICATIONS

Extended European Search Report from corresponding EP Application No. 17205355.5, dated Jun. 18, 2018.

(Continued)

*Primary Examiner* — Sean M Michalski
(74) *Attorney, Agent, or Firm* — Workman Nydegger

(57) ABSTRACT

A food singulator apparatus is configured to generate a sequence of spaced apart food slices from a food product conveyed by a conveyor apparatus. The apparatus includes an engagement member for engaging with a front side of the food product and temporarily halt the food product while cutting by a cutting device a front food slice of the food product, and a takeaway device for downwardly sliding the front food slice from the remaining part of the food product and slide it downwards and under the takeaway device where the food slice is subsequently received as an individual food slice.

15 Claims, 4 Drawing Sheets

(56) References Cited

U.S. PATENT DOCUMENTS 1,286,453 A * 12/1918 Van Berkel ..... B26D 7/32 83/91
1,310,262 A * 7/1919 Van Berkel ..... B26D 7/32 83/80
1,519,354 A * 12/1924 Brown ..... B26D 7/32 53/167
1,630,099 A * 5/1927 Van Berkel ..... B26D 7/32 83/92
1,663,643 A * 3/1928 Thomas ..... B26D 7/32 83/121
2,008,090 A * 7/1935 Walter ..... B26D 7/32 83/88
3,739,677 A * 6/1973 Muller ..... B26D 7/32 83/94
3,831,471 A * 8/1974 Rehlander ..... B26D 7/32 83/91
3,894,457 A * 7/1975 Miller ..... B26D 7/018 83/27
4,216,689 A * 8/1980 Suhling ..... B26D 7/32 83/77
4,405,186 A * 9/1983 Sandberg ..... B26D 7/32 271/218
4,518,300 A * 5/1985 Kent ..... B26D 7/32 414/790.3
4,552,048 A * 11/1985 Wallace ..... B26D 5/20 83/23
5,241,887 A * 9/1993 Wolff ..... B26D 1/20 83/248
5,475,917 A * 12/1995 Biagiotti ..... B26D 3/16 29/822
7,270,051 B2 * 9/2007 Hayashi ..... A21C 3/02 83/73
2004/0134319 A1 * 7/2004 Sandberg ..... B26D 5/007 83/13
2007/0214923 A1 9/2007 Maier
2011/0247470 A1 * 10/2011 Weber ..... B26D 7/2635 83/401
2011/0296964 A1 * 12/2011 Muller ..... B26D 7/08 83/23
2012/0089244 A1 * 4/2012 Weber ..... B26D 5/32 700/103
2013/0061729 A1 * 3/2013 Reifenhaeuser ..... B26D 7/32 83/26
2015/0040521 A1 * 2/2015 Hubner ..... B65B 9/04 53/513
2015/0047482 A1 * 2/2015 Stadtmuller ..... B26D 7/32 83/24
2015/0053057 A1 * 2/2015 Dreier ..... B65B 25/08 83/42

OTHER PUBLICATIONS

International Search Report and Written Opinion from PCT Application No. PCT/EP2018/083659, dated Mar. 4, 2019.

* cited by examiner

FOOD SINGULATOR APPARATUS

FIELD OF THE INVENTION

The present invention relates to a food singulator apparatus and a system for generating a sequence of spaced apart food slices from a food product conveyed by a conveyor apparatus, and to a method for performing the same.

BACKGROUND OF THE INVENTION

Meat processing devices such as portion cutters commonly cut an incoming food object, e.g. a loin, into food slices, that are used for creating batches or single portions of e.g. pre-defined weight target. A separation of the food slices is essential for allowing placing them into e.g. trays using e.g. robotic solutions. A common solution of creating such a separation between the individual food slices is to arrange two conveyors in an end-to-end arrangement where the downstream positioned conveyor runs at a higher speed sufficient to create a sufficient separation between adjacent food slices. However, a common problem that occurs is that adjacent food slices tend to stick together meaning that a manual labour is needed to separate them.

SUMMARY OF THE INVENTION

On the above background it is an object of embodiments of the present invention to provide an apparatus and a method that is capable of ensuring a separation of food slices after a food object has undergone a cutting process.

In general, the invention preferably seeks to mitigate, alleviate or eliminate one or more of the above mentioned disadvantages of the prior art singly or in any combination. In particular, it may be seen as an object of embodiments of the present invention to provide a food singulator apparatus that solves the above mentioned problems, or other problems.

To better address one or more of these concerns, in a first aspect of the invention a food singulator apparatus is provided configured to generate a sequence of spaced apart food slices from a food product conveyed by a conveyor apparatus, comprising:

a halting mechanism for engaging with a front side of the food product and temporarily halt the food product while cutting by a cutting device at least one food slice of the food product, and a take away device for downwardly sliding the at least one food slice from the remaining part of the food product and slide it downwards and under the take away device where the at least one food slice is subsequently received and conveyed as at least one food slice.

Accordingly, a simple solution is provided to ensure that the at least one front food slice is removed smoothly from the remaining part of the food product.

In one embodiment, the take away device comprises a tooth roll comprising a plurality of tooth wheels arranged in axially spaced apart arrangement.

In one embodiment, the halting mechanism may be operated by a control unit based on control data about the geometrical size and/or shape of the food product captured by an image device positioned upstream to the cutting blade. As an example, a cutting profile may be determined based on the image data and used as operation parameter in operating the movement of the halting mechanism.

This cutting profile may also be used in operating the internal distance between the cutting blade and the halting mechanism and the take away device. One way of doing so is to move the halting mechanism and the take away device towards the cutting device, or away from the cutting device, using appropriate moving mechanism that carries out this back and forth displacement of the halting mechanism and the take away device.

In one embodiment, the tooth roll is further configured to act as said halting mechanism. Accordingly, a simple solution is provided to utilize the tooth roll as both the take away device and the halting mechanism, preferably such that the tooth roll is operated in a stepwise manner where during said temporal halt the food product the tooth roll is stationary and subsequent to the at least one cut it slices, it rotates, thus provides said downward sliding of the at least one food slice.

The engagement member comprises in one embodiment a fence like structure comprising side by side arranged beams arranged in essentially the same space apart manner as the axially spaced apart tooth wheels, where the fence like structure is configured to be moved from a first position to a second position relative to the tooth roll, the first position being where the side by side arranged beams engage with the front side of the food product and temporarily halt the food product while cutting by the cutting device the at least one food slice of the food product, the second position being where the side by side arranged beams move into the space between the axially spaced apart tooth wheels thus allowing the tooth roll to engage with the front most of the at least one food slice of the food product. The side by side arranged beams are preferably arranged such that at the first angular position they are arranged parallel to the cutting plane. In one embodiment, the plurality of tooth wheels and/or the side by side arranged beams comprise plurality of spike-like structures. It is thus ensured that the friction/engagement between the front food slice is sufficient to smoothly downwards sliding it from the remaining part of the food product.

In one embodiment, the tooth roll is connected to a moving means for allowing the tooth roll to move in an upward/downward direction so as to allow it to supply a force onto the individual food slice while conveying it under the tooth roll. The moving means may according to the present invention be understood as e.g. a spring load or elastic member that allows the tooth roll to adjust to accommodate for difference in thicknesses of the food slices, i.e. so that it is lifted upwards for thicker food slices and moved downwards for thinner food slices via gravity.

In one embodiment, the take away device comprises a conveyor device comprising an endless belt rotatable around a horizontal rotation axis extending perpendicular to a conveyor direction of the food product, and where the halting mechanism comprises a side portion of the endless belt.

In an embodiment, the conveyor device is operated by a control unit in a stepwise manner such that during cutting of the at least one food slice, the conveyor device is temporarily stopped, and in such a manner that subsequent to sliding the at least one food slice downwards and under the take away device another portion of the endless belt is acting as the halting mechanism while cutting at least one subsequent food slice.

Thus, the conveyor device acts as both said halting mechanism and said take away device which simplifies the food singulator apparatus. As an example, the conveyor device could have a kind of a geometrical shape where one side, e.g. a flat vertical side, acts as the halting mechanism while at least one food slice is being cut while another side acts acting as said take away device. In that way, via e.g. a stepwise rotational movement of the conveyor device said halting, cutting and simultaneous singulation of the at least one food slices is provided.

In one embodiment, the conveyor apparatus comprises a first and a second conveyor devices arranged in an end-to-end arrangement with an opening there between, and where the cutting device has a cutting plane extending through the opening, where the first conveying device conveys the food product a first conveying speed, and the second conveyor device conveys the spaced apart food slices at a second conveying speed that is larger than the first conveying speed. It is thus ensured that the at least one cut food slice is immediately removed from the remaining part of the food product.

In one embodiment, the food singulator apparatus further comprises a supporting structure connected to an advancing mechanism positioned above the first conveyor device, where the supporting structure is configured to support a downward force onto the food product during cutting, and where the advancing mechanism is configured to move with the same speed and direction as the first conveying device. It is thus ensured that the food product is remained stable during cutting.

In one embodiment, the food singulator apparatus further comprises a moving mechanism for lifting the take away device upwards and thus provide a bypass position for the food product or the last food part of the food object. It is thus possible to let the food product or a part of the food product, e.g. the very last part of it, to pass under the food singulator apparatus where said cutting a step is not to be performed. Another example is where a front portion of the food product is to be cut into x many slices and the rear part of the food product into y many slices, whereby the intermediate part there between is to be bypassed via said moving mechanism, e.g. because this part may have higher price/kg that those of the food slices. Accordingly, in this example, a sequence of x spaced apart food slices is made as described above, subsequently the intermedia part of length 1 is bypassed as described above, and subsequently the cutting is continued and the sequence of y spaced apart food slices is made. The bypassed part does of course not need to be the intermediate part but may be any part of the food product.

In another aspect of the invention, a method is provided for generating a sequence of spaced apart food slices from a food product conveyed by a conveyor apparatus, comprising:

engaging with a front side of the food product, by a halting mechanism, and temporarily halting the food product while cutting by a cutting device at least one food slice of the food product, and downwardly sliding, by a take away device, the front food slice from the remaining part of the food product and slide it downwards and under the take away device where the at least one slice is subsequently received as at least one food slice.

In one embodiment, the at least one food slice is a single food slice. Accordingly, a simple solution is provided to cut one food slice at a time and make a separation of the individual cut food slices.

In yet another aspect of the invention, a system is provided for cutting incoming food objects into slices, comprising:

a conveyor for conveying food products to be cut, an image device for capturing image data of the food objects, a control unit, and a food singulator apparatus operated by the control unit by using the image data, wherein the food singulator apparatus is configured to generate a sequence of spaced apart food slices from the food products, where the food singulator comprises:

a halting mechanism for, according to instructions from the control unit, engaging with a front side of a food product and temporarily halting the food product while a cutting device cuts at least one food slice of the food product, and a take away device for downwardly sliding the at least one food slice from the remaining part of the food product and under the take away device where the at least one food slice is subsequently received and conveyed as at least one food slice.

The image device may as an example comprise a digital camera, any type of a scanner such as line scanner, that may as an example generate a 3D profile of food objects. Referring to the example above, this input data may be utilized in deciding on the size of the portion of a given good object that is to be bypassed. This may be quality related with the aim of maximizing the yield of the resulting food slices/portion (s).

In one embodiment, the image data is utilized in generating a cutting pattern for the food products. As an example, the cutting pattern may show different thicknesses of the food slices e.g. such that they fulfil a pre-defined criterion such as a fixed weight criterion, where e.g. the position of the halting mechanism from the cutting device may be adjusted accordingly via a moving mechanism, i.e. moved toward the cutting device or away from the cutting device.

In one embodiment, the at least one food slice comprises two or more food slices. Accordingly, it is possible to cut two or more food slices and provide a separation between the two or more food slices, where the two or more food slices may fulfil a pre-defined target such as number of slices in e.g. a tray, or a pre-defined weight target.

BRIEF DESCRIPTION OF THE DRAWINGS

Embodiments of the invention will be described, by way of example only, with reference to the drawings, in which.

DESCRIPTION OF EMBODIMENTS

Figure 1A:
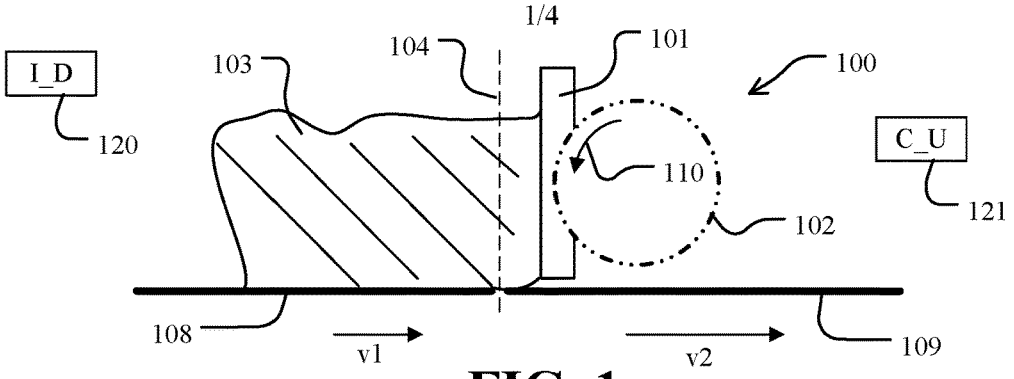
FIGS. 1*a* to 1*d* show one embodiment of a singulator apparatus according to the present invention for generating a sequence of spaced apart food slices from a food product conveyed by a conveyor apparatus.

FIGS. 1*a* to 1*d* show one embodiment of a singulator apparatus 100 according to the present invention for generating a sequence of spaced apart food slices from a food product conveyed by a conveyor apparatus, where the apparatus comprises a halting mechanism 101 and a take away device 102.

As will be discussed in more details in relation to the embodiments shown in FIGS. 2*a* to 3*c*, the take away device comprises a tooth roll comprising a plurality of tooth wheels arranged in axially spaced apart arrangement (see FIGS. 2*a* to 2*c*), and the engagement member 101 comprises a fence like structure comprising side by side arranged beams arranged in essentially the same spaced apart manner as the axially spaced apart tooth wheels.

The dotted line 104 indicates a cutting place of a cutting blade 105, where the cutting blade is positioned between conveyors 108, 109 that are arranged in an end-to-end arrangement, where the upstream arranged conveyor 108 runs at a conveying speed v1 which is less than the conveying speed v2 of the downstream arranged conveyor 109.

FIG. 1*a* shows the fence like structure 101 being in a first position, where it is positioned in essentially vertical position and engages with a front side of the food product and temporarily halts the food product 103. As shown here, the tooth roll 102 rotates in a direction as indicated by arrow 110.

Figure 1B:
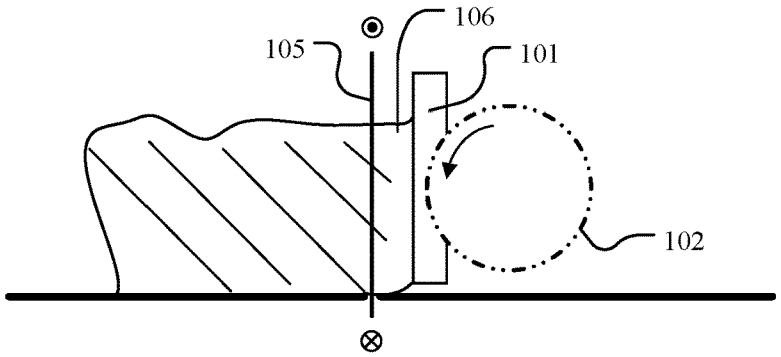

FIG. 1*b* shows the cutting blade 105 rotating perpendicular to the conveying direction while cutting at least one food slice 106.

For simplicity, it will be assumed that a single food slice is to be cut at a time and be separated from the remaining part of the product. This should however not be construed as being limited to cutting a single food slice at a time, but two or more food slices might just as well be cut and be separated as e.g. a batch of food slices.

The food slice typically has a pre-defined thickness that is defined via the distance from the engagement member 101 and the vertical cutting plane 104.

Figure 1C:
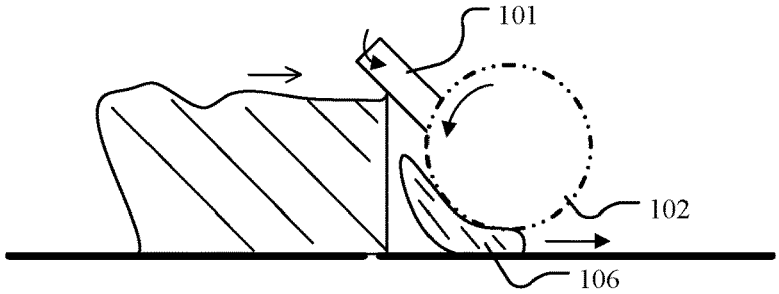
Figure 1D:
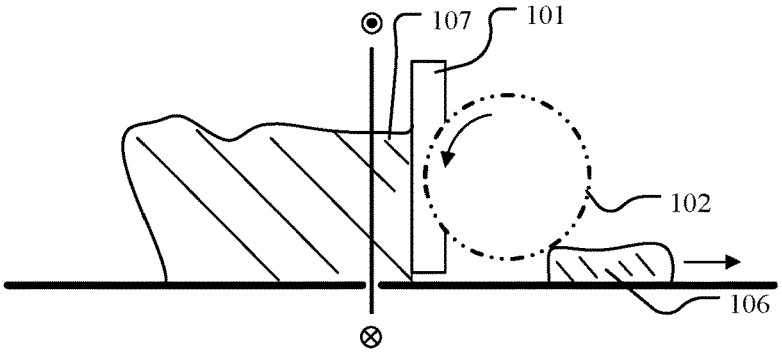

FIG. 1*c* shows where the fence like structure is moved from the first position, where the fence like structure engages with the front side of the food product 103, to a second position relative to the tooth roll 102. The second position is where the side by side arranged beams move into the space between the axially spaced apart tooth wheels thus allowing the tooth roll 102 to engage with the front food slice of the food product and slides the front food slice downwards as shown and under the tooth roll where the food slice is subsequently received as an individual food slice and conveyed by a conveyor device 109. Subsequently, the engagement member 101 is moved back to the first position as shown in FIG. 1*d* and the above mentioned steps are repeated.

The stepwise movement of the fence like structure 101 may be operated by a control unit 121 based on control data about the geometrical size and shape of the food product captured by an image device 120 positioned upstream to the cutting blade 105. As an example, cutting profile may be determined based on the image data and used as operation parameter in operating the movement of the fence like structure 101. Another operation parameter is the internal distance between the cutting blade 105 and the fence like structure 101 where either one of the cutting blade 105 and the fence like structure 101, or both, are adjusted horizontally such that the thickness of the food slice is in line with the cutting pattern.

Figure 2A:
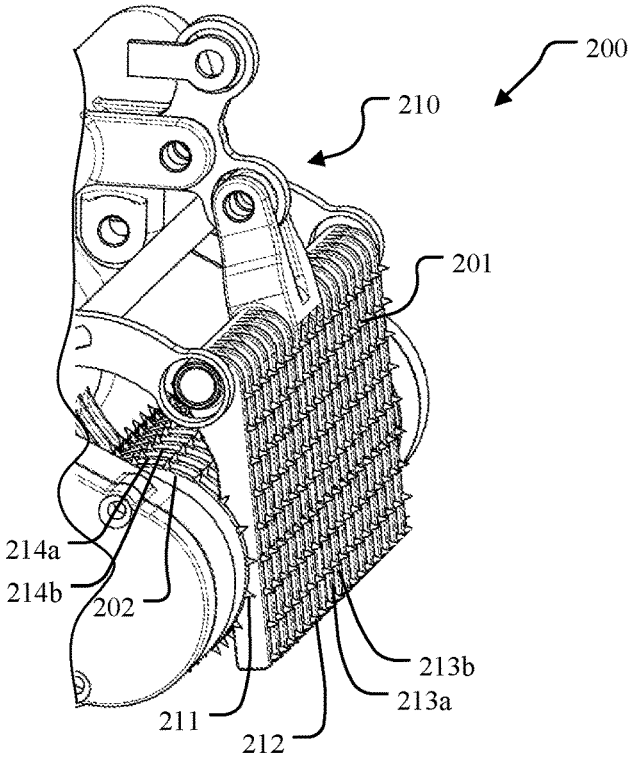
FIGS. 2*a* to 2*c* show a more detailed view of the singulator apparatus discussed in relation to FIGS. 1*a* to 1*d*, FIGS. 3*a* to 3*c* show another embodiment of a singulator apparatus according to the present invention.
Figure 2B:
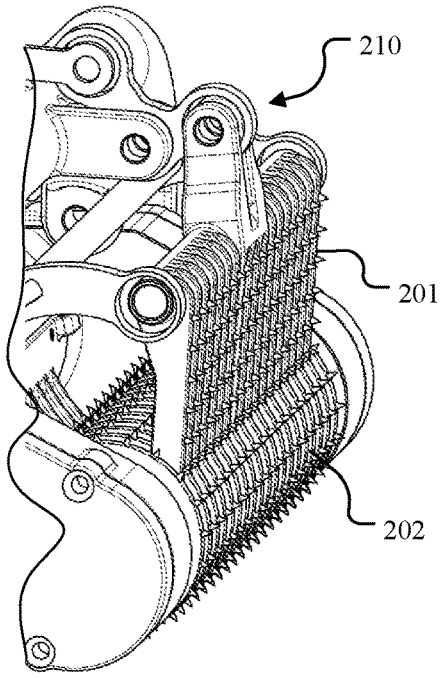
Figure 2C:
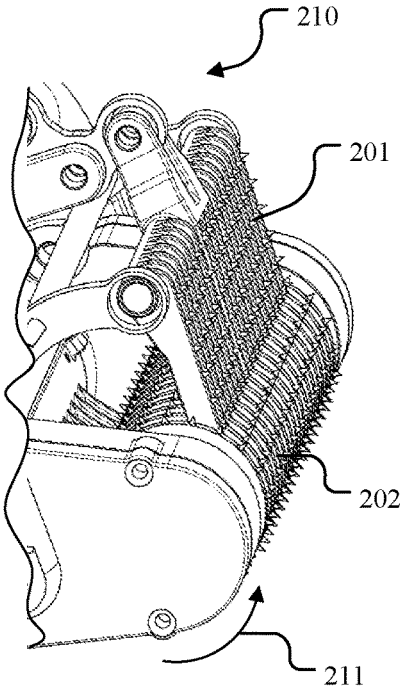

FIGS. 2*a* to 2*c* show one embodiment of a singulator apparatus 200 as discussed in relation to FIGS. 1*a* to 1*d*, showing in more details the tooth roll 202 comprising the axially spaced apart tooth wheels 214*a,b*, and the fence like structure 201 connected to a moving mechanism 210.

The fence like structure comprises side by side arranged beams 213*a,b* arranged in essentially the same space apart manner as the axially spaced apart tooth wheels. As shown here, the tooth wheels 214*a,b* and side by side arranged beams 213*a,b* comprise plurality of spike-like structures 211, 212 to ensure that the friction/engagement between the front food slice is sufficient to smoothly downwards sliding it from the remaining part of the food product.

FIG. 2*a* shows the fence like structure being in said first position as shown in FIGS. 1*a* and 1*b* where it engages with the front side of the food product.

FIG. 2*b* shows the fence like structure is in said second position as shown in FIG. 1*c* where the tooth roll 201 is capable of engaging with the front food slice and slide it under the tooth roll as discussed in relation to FIG. 1*c*.

FIG. 2*c* shows the singulator apparatus 200 being in a bypass position where it is capable of being lifting upwards as indicated by arrow 211 to allow e.g. the very last food part of the food object to be bypassed under the singulator apparatus 200.

Figure 3A:
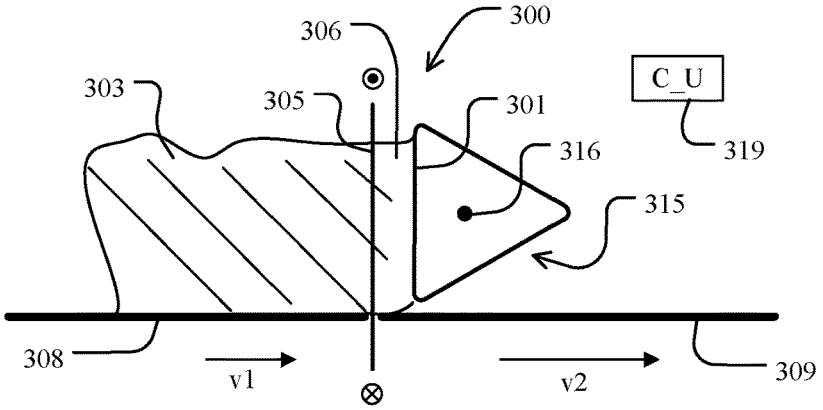
Figure 3B:
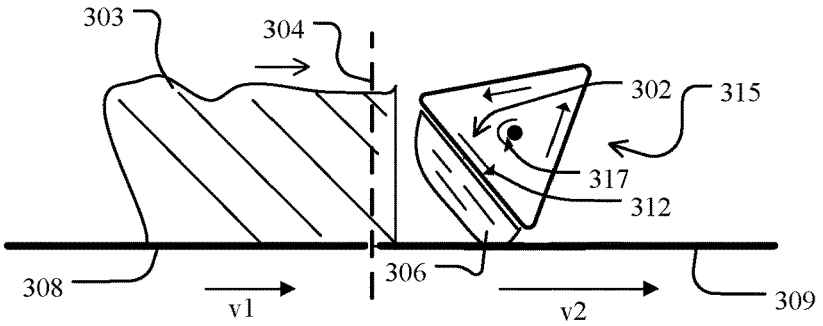
Figure 3C:
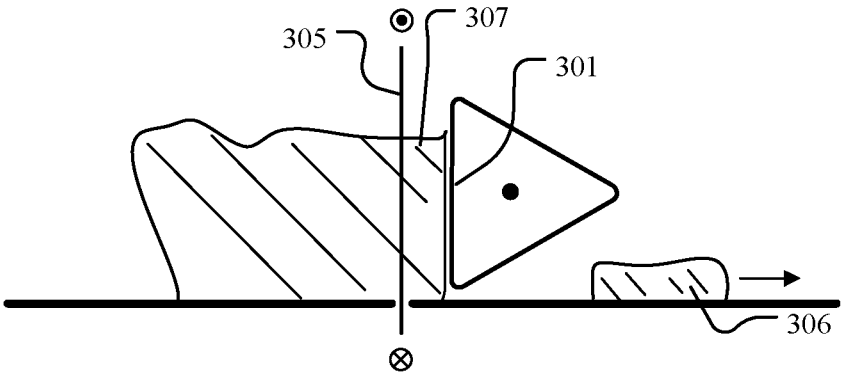

FIGS. 3*a* to 3*c* show another embodiment of a singulator apparatus 300 according to the present invention for generating a sequence of spaced apart food slices from a food product conveyed by a conveyor apparatus, where similar as in FIGS. 1*a* to 1*d* the conveyor apparatus comprises end-to end arranged conveyors 308, 309, where the apparatus comprises a halting mechanism and a take away device.

In this embodiment, the take away device comprises a conveyor device 315 operated by a control unit 319 which operates the conveyor device in a stepwise manner.

In this particular example the conveyor device 315 has a triangular cross sectional view, comprising an endless belt and is rotatable around a horizontal rotation axis 316 extending parallel to a conveyor direction of the food product 303.

FIG. 3*a* shows the scenario where the conveyor device 301 is stopped and where the surface 301 of the conveyor device 315 is in contact with the front end of the food product 303 and acts as the halting mechanism. During this halting, the cutting device 305 cuts a food slice 306.

FIG. 3*b* shows the scenario where the conveyor device 315 runs in a direction as indicated by arrow 312 and simultaneously rotates around the rotation axis 316 as indicated by arrow 317 causing the front food slice to slide downwards and under the conveyor device 301.

FIG. 3*c* shows where the next adjacent side of the conveyor device acts as a halting mechanism 301 for the subsequent food slice 307. These steps are then repeated.

Figure 4:
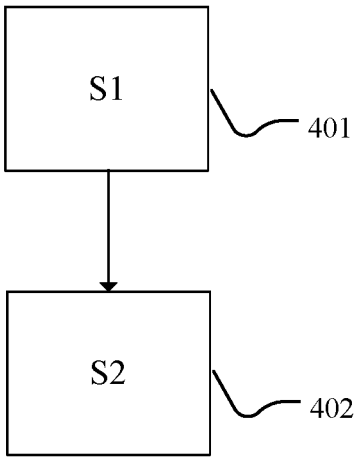
FIG. 4 illustrates a flowchart of a method according to the present invention.

FIG. 4 is flowchart of a method according to the present invention to generate a sequence of spaced apart food slices from a food product conveyed by a conveyor apparatus.

Step (51) 401 includes engaging with a front side of the food product, by a halting mechanism, and temporarily halting the food product while cutting by a cutting device at least one food slice of the food product. The halting mechanism may as an example comprise the fence like structure discussed previously in relation to FIGS. 1*a* to 3*c*.

Step (S2) 402 includes downwardly sliding, by a take away device, the at least one food slice from the remaining part of the food product and slide it downwards and under the take away device where the at least one food slice is subsequently received and conveyed as at least one food slice.

The operation of the halting mechanism may as previously discussed be based on captured image data that are processed to determine a cutting pattern for the food product, where the cutting pattern may include thicknesses of the food slices to be cut. The different thicknesses may be operated by adjusting the internal position between halting mechanism and/or the take away device via appropriate moving mechanism.

The cutting pattern may also indicate a larger food portion that is to be bypassed by the food singulator apparatus, i.e. that is not to be cut into food slices, by simply lifting the food singulator apparatus upwards so as to allow a portion of the food product to pass under the food singulator apparatus.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The invention claimed is:

1. A food singulator apparatus configured to generate a sequence of spaced apart food slices from a food product conveyed by a conveyor apparatus, comprising:

an engagement member for engaging with a front side of the food product and temporarily halting the food product while cutting by a cutting device arranged to cut at least one food slice of the food product, and a takeaway device for downwardly sliding the at least one food slice from the remaining part of the food product and sliding it downwards and under the takeaway device where the at least one food slice is subsequently received and conveyed as at least one food slice.

2. The food singulator apparatus according to claim 1, wherein the takeaway device comprises a tooth roll comprising a plurality of tooth wheels arranged in an axially spaced-apart arrangement.

3. The food singulator apparatus according to claim 1, wherein the tooth roll is configured to act as said engagement member.

4. The food singulator apparatus according to claim 1, wherein the engagement member comprises a fence-like structure comprising side-by-side arranged beams arranged is in a spaced apart manner as the axially spaced-apart tooth wheels, wherein the fence-like structure is configured to be moved from a first position to a second position relative to the tooth roll, the first position being where the side-by-side arranged beams engage with the front side of the food product and temporarily halt the food product while cutting by the cutting device arranged to cut at least one food slice of the food product, the second position being where the side-by-side arranged beams move into the space between the axially spaced-apart tooth wheels thus allowing the tooth roll to engage with the front most of the at least one food slice of the food product.

5. The food singulator apparatus according to claim 4, wherein the side-by-side arranged beams are configured in a first angular position comprising placing the side-by-side arranged beams vertically in relation to the conveying direction.

6. The food singulator apparatus according to claim 2, wherein the plurality of tooth wheels or the side-by-side arranged beams comprise plurality of spike-like structures.

7. The food singulator apparatus according to claim 2, wherein the tooth roll is connected to a moving means for allowing the tooth roll to move in an upward/downward direction so as to allow it to accommodate for difference in thickness for an individual food slice while conveying it under the tooth roll.

8. The food singulator apparatus according to claim 1, wherein the takeaway device comprises a conveyor device comprising an endless belt rotatable around a horizontal rotation axis extending perpendicular to a conveyor direction of the food product, and where the engagement member comprises a side portion of the endless belt.

9. The food singulator apparatus according to claim 8, wherein the conveyor device is operated by a control unit in a stepwise manner such that during cutting of the at least one food slice, the conveyor device is temporarily stopped, and in such a manner that subsequent to sliding the at least one food slice downwards and under the takeaway device another portion of the endless belt is acting as the engagement member while cutting at least one subsequent food slice.

10. The food singulator apparatus according to claim 1, wherein the conveyor apparatus comprises a first and a second conveyor devices arranged in an end-to-end arrangement with an opening there between, and where the cutting device has a cutting plane extending through the opening, where the first conveying device conveys the food product at a first conveying speed, and the second conveyor device conveys the spaced apart food slices at a second conveying speed that is larger than the first conveying speed.

11. The food singulator apparatus according to claim 10, further comprising a supporting structure connected to an advancing mechanism positioned above the first conveyor device, where the supporting structure is configured to supply a downward force onto the food product during cutting, and where the advancing mechanism is configured move with the same speed and in the same direction as the first conveying device.

12. The food singulator apparatus according to claim 1, further comprising a moving mechanism for lifting the takeaway device upwards and provide a bypass position for the food product or the previous food part of the food object.

13. A method to generate a sequence of spaced apart food slices from a food product conveyed by a conveyor apparatus, comprising:

engaging with a front side of the food product, by an engagement member, and temporarily halting the food product while cutting by a cutting device arranged to cut at least one food slice of the food product, and downwardly sliding, by a takeaway device, the at least one food slice from the remaining part of the food product and sliding it downwards and under the takeaway device where the at least one food slice is subsequently received and conveyed as at least one food slice.

14. A system for cutting incoming food objects into slices, comprising:

a conveyor for conveying food products to be cut, an image device for capturing image data of the incoming food objects, a control unit, and a food singulator apparatus operated by the control unit by using the image data, wherein the food singulator apparatus is configured to generate a sequence of spaced apart food slices from the food products, where the food singulator comprises:

an engagement member for, according to instructions from the control unit, engaging with a front side of a food product and temporarily halting the food product while a cutting device cuts at least one food slice of the food product, and a takeaway device for downwardly sliding the at least one food slice from a remaining part of the food product and under the takeaway device where the at least one food slice is subsequently received and conveyed as at least one food slice.

15. The system according to claim 14, wherein the image data is utilized in generating a cutting pattern for cutting the food products.

* * * * *